US010051979B2

(12) United States Patent
Kuo

(10) Patent No.: US 10,051,979 B2
(45) Date of Patent: Aug. 21, 2018

(54) STACKABLE CAN RACK ASSEMBLY

(71) Applicant: EP Family Corp., Walnut, CA (US)

(72) Inventor: Hung-Chih Kuo, Walnut, CA (US)

( * ) Notice: Subject to any disclaimer, the term of this patent is extended or adjusted under 35 U.S.C. 154(b) by 32 days.

(21) Appl. No.: 15/368,422

(22) Filed: Dec. 2, 2016

(65) Prior Publication Data

US 2018/0153303 A1 Jun. 7, 2018

(51) Int. Cl.

| | |
|---|---|
| ***A47F 5/13*** | (2006.01) |
| ***A47F 5/01*** | (2006.01) |
| ***B42F 7/12*** | (2006.01) |
| ***A47B 55/02*** | (2006.01) |
| ***A47F 5/00*** | (2006.01) |
| ***A47F 7/14*** | (2006.01) |

(52) U.S. Cl.

CPC ..... *A47F 5/13* (2013.01); *A47B 55/02* (2013.01); *A47F 5/0031* (2013.01); *A47F 5/01* (2013.01); *A47F 7/148* (2013.01); *B42F 7/12* (2013.01)

(58) Field of Classification Search

CPC .... A47F 5/13; A47F 1/121; A47F 5/01; A47F 7/148; A47F 5/0031; A47F 1/082; A47F 5/0025; A47F 5/135; A47F 5/14; A47F 5/00; A47F 5/0018; A47F 5/0043; A47F 5/0056; A47F 2005/165; A47F 7/0007; A47F 7/145; A47F 7/0014; B65D 21/0211; B42F 7/12; B42F 7/10; A47B 47/027; A47B 55/02; A47B 57/10; A47B 87/0207; A47B 96/02; A47B 87/0269; A47B 87/0276; A47B 47/021; A47B 57/06; A47B 57/08; A47B 57/12; A47B 63/00; A47B 87/00; A47B 87/001; A47B 87/02; A47B 87/0215; A47B 87/0261; A47B 87/0284; A47B 87/0292

USPC ..... 211/59.2, 11, 10, 126.13, 133.5, 133.1, 211/133.2, 133.3, 128.1, 126.2, 126.1, 211/126.9, 181.1, 49.1, 189, 186, 187, 211/190, 188, 194; 312/72

See application file for complete search history.

(56) References Cited

U.S. PATENT DOCUMENTS 3,160,308 A * 12/1964 Hare ..... B65D 21/046 206/507
3,232,442 A * 2/1966 Wilson ..... A47F 5/01 211/126.15
3,435,958 A * 4/1969 Chesley ..... A47F 5/0031 108/107

(Continued)

*Primary Examiner* — Hiwot E Tefera

(74) *Attorney, Agent, or Firm* — Tommy S F Wang; Wang JP Law Group, P.C.

(57) ABSTRACT

A stackable can rack assembly provides a plurality of modular racks that facilitate both the loading of cans and the presentation of the cans for removal by a consumer. Multiple modular racks can be configured in a variety of stacked arrangement. A plurality of shelves are disposed at a slope to create a gravity fed arrangement to enable the cans to roll forward for dispensing. A pair of side panels support the shelves. The side panels comprise a top flat bar defined by a convex hump having a flat surface, and a bottom flat bar defined by a concave hump having a flat surface. The humps couple together and the flat surface enhance stability for stacking multiple modular racks. At least one bracket affixes to the bottom flat bar to fasten the top and bottom flat bars together. A back panel provide structural integrity to the modular racks.

13 Claims, 8 Drawing Sheets

(56) References Cited

U.S. PATENT DOCUMENTS

| | | | | | |
|---|---|---|---|---|---|
| 3,606,022 | A * | 9/1971 | Beesley | A47B 87/0269 | 211/181.1 |
| 3,915,097 | A * | 10/1975 | Young, Jr. | A47F 5/12 | 108/163 |
| 4,416,380 | A * | 11/1983 | Flum | A47F 1/121 | 211/181.1 |
| 4,426,008 | A * | 1/1984 | Olson | A47F 1/082 | 211/194 |
| 4,456,125 | A * | 6/1984 | Chap | B65D 25/22 | 206/513 |
| 4,978,013 | A * | 12/1990 | Hogg | A47F 5/13 | 211/132.1 |
| D321,609 | S * | 11/1991 | Dardashti | D6/675.2 | |
| 5,221,014 | A * | 6/1993 | Welch | A47B 55/02 | 211/181.1 |
| D579,691 | S * | 11/2008 | Snider | D6/675.2 | |
| D699,986 | S * | 2/2014 | Tsai | D6/675.4 | |
| D736,014 | S * | 8/2015 | Tsai | D6/675.2 | |
| D757,176 | S * | 5/2016 | Tsai | D19/92 | |
| D757,177 | S * | 5/2016 | Tsai | D19/92 | |
| 9,534,834 | B1 * | 1/2017 | Klassen | A47B 46/00 | |
| 9,648,953 | B1 * | 5/2017 | Kuo | A47B 88/9418 | |
| 9,782,996 | B1 * | 10/2017 | Kuo | B42F 7/12 | |
| D804,225 | S * | 12/2017 | Bian | D6/675.5 | |
| 2002/0008074 | A1 * | 1/2002 | Spencer | A47F 7/148 | 211/49.1 |
| 2006/0043034 | A1 * | 3/2006 | Vanderslice | A47F 1/12 | 211/59.2 |
| 2008/0029467 | A1 * | 2/2008 | Colin | A47F 5/13 | 211/59.2 |
| 2009/0272706 | A1 * | 11/2009 | Gusdorf | A47B 55/02 | 211/153 |

* cited by examiner

STACKABLE CAN RACK ASSEMBLY

FIELD OF THE INVENTION

The present invention relates generally to a stackable can rack assembly. More so, the present invention relates to a can rack assembly that provides a plurality of modular racks that serve to facilitate both the loading of cans and the presentation of the cans for removal by a consumer, while also enabling multiple modular racks to be configured into multiple stacked arrangements through the use of side panels comprising flat bars having convex and concave humps, and further brackets that help fasten the flat bars together.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, wire racks and shelves consists of wire mesh supported by metal supports and is intended to be load-bearing. The mesh is usually welded to the supports, but may be attached in other ways as well. In commercial and industrial applications, the wire mesh usually has a minimum wire gauge of 0.105 inches when round wire is used. The most common shelf size is 42 inches deep by 46 inches wide, while two such shelves placed side-by-side can usually be combined to allow for a single shelf of 8 feet wide.

Generally, supermarkets and similar merchandising establishments display and sell a great deal of merchandise contained in cans such as soups, soft drinks or other products. In such large volume establishments it is necessary from time to time to maintain a proper supply of cans on the shelves and at the same time to display them with maximum advantage both for convenience so that the customer can find a desired canned product, as well as to promote any particular canned items.

Often, cans stacked on end on top of each other on ordinary rigid supermarket shelves do not readily dispense from the shelf, sometimes fall when the customer attempts to remove them, and requires some amount of care in stacking or tumbling will result. Due to shelf space concerns in supermarkets, the can racks are not large enough to accommodate all the cans available for display and sale.

Other proposals have involved racks for displaying and dispensing canned items. The problem with these racks is that they have limited space and surface area. Even though the above cited racks devices meets some of the needs of the market, a can rack assembly that provides a plurality of modular racks that serve to facilitate both the loading of cans and the presentation of the cans for removal by a consumer, while also enabling multiple modular racks to be configured into multiple stacked arrangements through the use of side panels comprising flat bars having convex and concave humps, and further brackets that help fasten the flat bars together is still desired.

SUMMARY

Illustrative embodiments of the disclosure are generally directed to a stackable can rack assembly. The stackable can rack assembly provides a plurality of modular racks that join together in various stacked and adjacent arrangements to facilitate both the loading of cans and the presentation of the cans for removal by a consumer. The stackable can rack assembly also utilizes flat bars with flat surfaces to provide stable stacking arrangements, and a concave-convex hump configuration, along with at least one bracket to further enhance stability for stacking the modular racks.

In some embodiments, the stackable can rack assembly comprises a plurality of modular racks. The modular racks are configured to display cans and enable facilitated access to the cans. The modular racks utilize a sloped disposition to enhance viewing the sides of the cans, and also to allow the cans to be gravity fed for dispensing.

The modular racks can be stacked in various arrangements. In one embodiment, the modular racks are stacked in a vertical stacked configuration. In another embodiment, two modular racks can support a single modular rack. The modular racks utilize flat surface to enable stable stacking. The modular racks also utilize a coupling effect between convex and concave humps the form along the length of the flat bars to further stabilize the stacked configuration. The modular racks also utilize at least one bracket operable along the flat bars to further stabilize the stacked configuration.

In some embodiments, the modular racks may include a plurality of shelves. The shelves are load bearing to support the cans on their sides for display and dispensing. In one embodiment, the cans are arranged in series and roll along the plane of the shelves through a gravity fed configuration. The shelves are defined by wire mesh arranged in a spaced-apart relationship. The shelves are further defined by a pair of side edges, a rear edge, and a front edge having a lip. The edges are disposed at opposing ends of the wire mesh.

The shelves are disposed in a generally parallel, spaced-apart relationship, such that cans display vertically. Further, the shelves are disposed at an angle, such that the rear edge is elevated above the front edge. This allows the cans to roll form the rear edge to the front edge. The lip on the front edge restricts further rolling by the cans.

The modular racks further comprises a pair of side panels configured to join with the pair of side edges of the plurality of shelves to help support the plurality of shelves. The pair of side panels also work to support subsequent modular racks in the stacked configuration.

In one embodiment, the side panels comprise a top flat bar defined by a convex hump having a flat surface. The entire length of the top flat bar, including the upper and lower surfaces of the convex hump are substantially flat. The side panels further comprise a bottom flat bar defined by a concave hump having a flat surface. The entire length of the bottom flat bar, including the upper and lower surfaces of the concave hump are substantially flat. In this manner, the convex hump couples to the concave hump to enable stacking of the plurality of modular racks.

In some embodiments, at least one bracket joins with the concave hump of the bottom flat bar. The bracket is configured to help fasten the bottom flat bar to the top flat bar, such that stability is enhanced for stacking the modular racks. In one embodiment, the bracket includes a generally U-shape that is sized and dimensioned to at least partially encapsulate the top flat bar in the stacked arrangement, such that the bracket snugly fits around the sides of the bottom and top flat bars.

In some embodiments, a pair of support bars are disposed in a parallel, spaced-apart relationship, extending between the top flat bar and the bottom flat bar. The support bars are disposed generally perpendicular to the flat bars.

In some embodiments, the modular rack further comprises a back panel disposed generally perpendicular to the pair of side panels. The back panel joins with the rear edge of the plurality of shelves to help support the plurality of shelves. The back panel, the pair of side panels, and the plurality of shelves are detachably attachable to enable compacting for stowage and easy assembly for operation. Various fasteners, friction fit coupling arrangements, and the like may be used to join the panels and shelves.

In another aspect, the plurality of shelves are generally rectangular.

In another aspect, the wire mesh of the plurality of shelves are disposed in a parallel, spaced-apart relationship.

In yet another aspect, the lip extends upwardly in the direction of the rear edge of the plurality of shelves.

In yet another aspect, the wire mesh of the plurality of shelves are configured to enable carrying multiple cans.

In yet another aspect, the multiple cans are gravity fed from the rear edge to the front edge of the plurality of shelves.

In yet another aspect, the pair of side panels are generally rectangular and flat.

In yet another aspect, the top flat bar and the bottom flat bar are generally elongated.

In yet another aspect, the pair of side panels comprises side wire mesh configured to enhance structural integrity of the pair of side panels.

In yet another aspect, the convex hump and the concave hump are configured to form a friction fit relationship.

In yet another aspect, the at least one bracket comprises a generally U-shape that is sized and dimensioned to at least partially encapsulate the top flat bar when multiple modular racks are in a stacked arrangement.

In yet another aspect, the pair of support bars are disposed generally perpendicular to the flat bars.

In yet another aspect, the back panel is generally rectangular and flat.

In yet another aspect, the back panel comprises a pair of back support bars disposed in a spaced-apart relationship.

In yet another aspect, the back panel comprises back wire mesh configured to extend between the pair of back support bars for enhancing structural integrity of the back panel.

One objective of the present invention is to facilitate both the loading of cans and the presentation of the cans for removal by a consumer.

Another objective is to stack multiple can racks on flat bars having concave and convex humps.

Another objective is to provide brackets at the ends of the humps to fasten the flat bars together.

Yet another objective is to configure the modular racks in multiple stacked arrangements.

Yet another objective is to stack the modular racks with minimal amount of tools and fasteners.

Yet another objective is to provide an inexpensive to manufacture can rack.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A stackable can rack assembly 100 is referenced in FIGS. 1-16. The stackable can rack assembly 100, hereafter "assembly 100" provides a plurality of modular racks 102*a*, 102*b* that join together in various stacked and adjacent arrangements to facilitate both the loading of cans and the presentation of the cans, so that a consumer may easily access the cans. The modular racks 102*a*, 102*b* may be configured into multiple stacked, modular arrangements, such as two racks stacked atop each other. The modular racks 102*a*, 102*b* may then easily be rearranged to position adjacently to each other, or possible adding additional modular racks to the stacked arrangement.

The various panels of the modular racks 102*a* utilizes flat bars with flat surfaces to provide stable stacking arrangements. The flat bars are configured with a concave-convex hump configuration, along with at least one bracket 126*a*, 126*b*, 126*c*, 126*d*, to further enhance stability for stacking the modular racks 102*a*, 102*b*. The modular racks 102*a*, 102*b* also provide sloped shelves 104*a-c* that enable cans to roll to the front for enhanced visibility and facilitated access.

Figure 1:
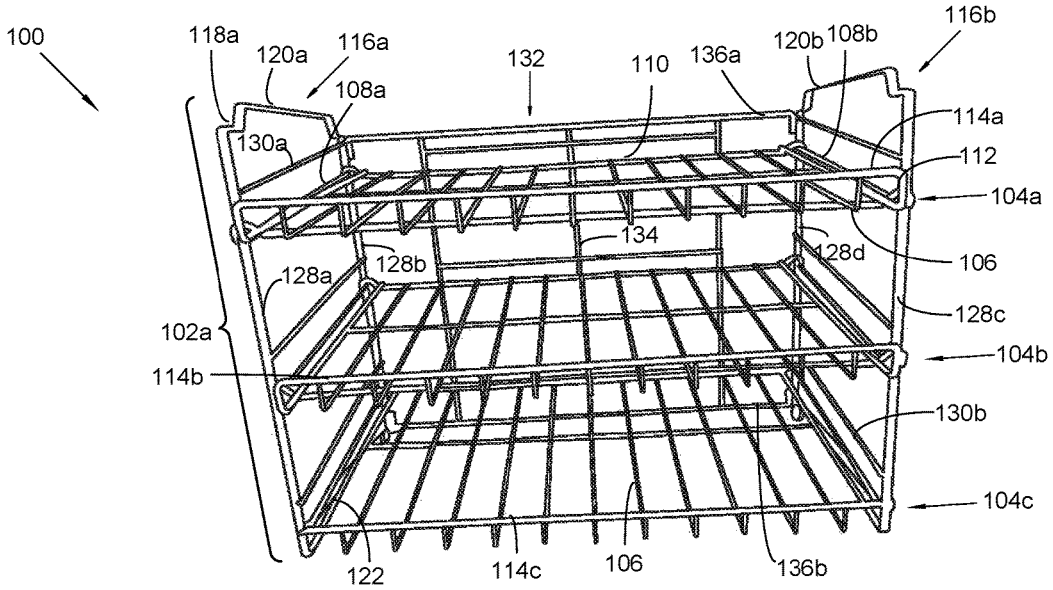
FIG. 1 illustrates a front perspective view of an exemplary stackable can rack assembly, in accordance with an embodiment of the present invention.

As referenced in FIG. 1, the assembly 100 comprises a plurality of modular racks 102*a*, 102*b* that are lightweight, mobile, collapsible, and easily assembled to form a variety of stacked arrangement. A plurality of shelves 104*a*, 104*b*, 104*c* are disposed at a slope to create a gravity fed configuration that enables the cans to roll forward for dispensing. The cans may include a cylindrical can containing food, liquids, gels, granular members, oil, and other items known in the art. In an alternative embodiments, the shelves 104*a*, 104*b*, 104*c* may support bottles or other containers that have a capacity to roll down an angled shelf.

Figure 2:
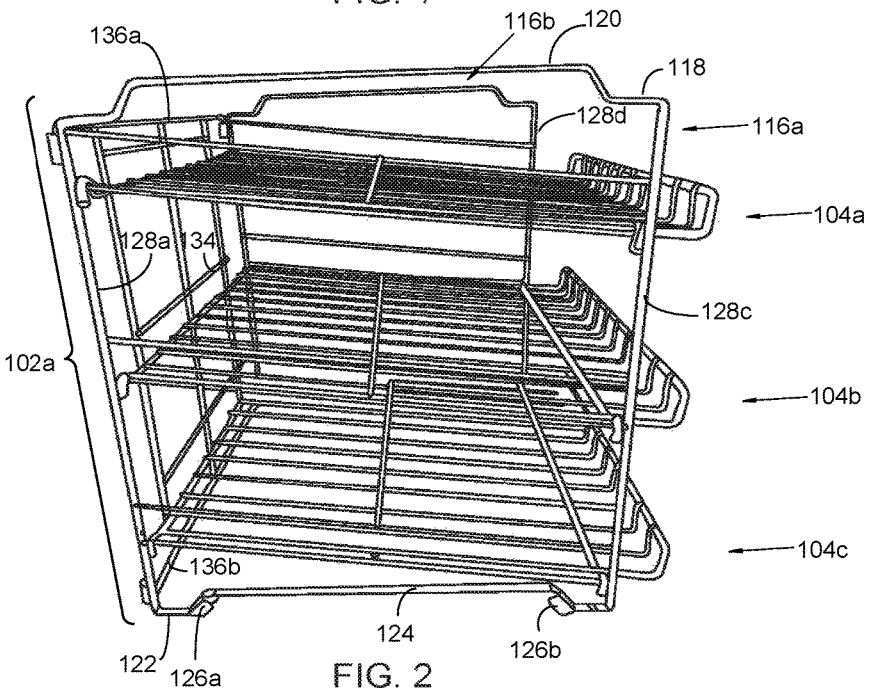
FIG. 2 illustrates a side perspective view of the stackable can rack assembly shown in FIG. 1, in accordance with an embodiment of the present invention.

As FIG. 2 shows, a pair of side panels 116*a*, 116*b* on the ends of the shelves 104*a*, 104*b*, 104*c* provide structural support to the shelves 104*a*, 104*b*, 104*c*. The side panels 116*a*, 116*b* comprise a top flat bar 118*a*, 118*b* defined by a convex hump 120*a*, 120*b* having a flat surface, and a bottom flat bar 122*a*, 122*b* defined by a concave hump 124*a*, 124*b* having a flat surface. The humps couple together and the flat surface enhance stability for stacking multiple modular racks 102*a*, 102*b*. At least one bracket 126*a*, 126*b*, 126*c*, 126*d* affixes to the bottom flat bar 122*a*, 122*b* to fasten the top and bottom flat bars 118*a*, 118*b*, 122*a*, 122*b* together. A back panel 132 provide structural integrity to the modular racks 102*a*, 102*b*.

Figure 3:
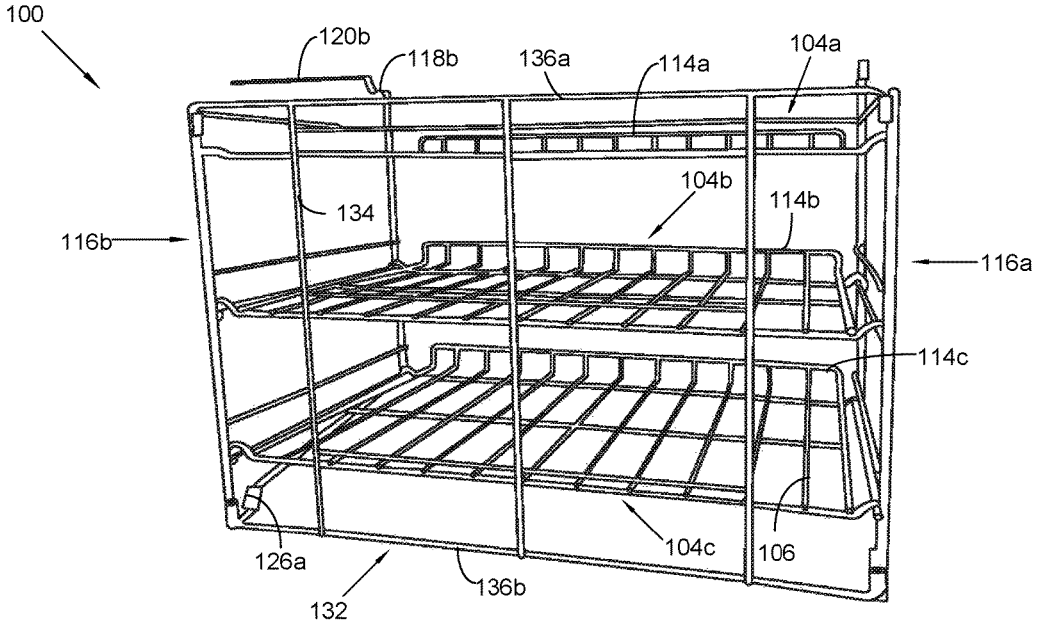
FIG. 3 illustrates a rear perspective view of the stackable can rack assembly shown in FIG. 1, in accordance with an embodiment of the present invention.

Turning now to FIG. 3, the modular racks 102*a*, 102*b* may include a plurality of shelves 104*a*, 104*b*, 104*c*. The shelves 104*a*, 104*b*, 104*c* are load bearing to support the cans lying on their sides for display and dispensing. In one embodiment, the cans are arranged in series and roll along the plane of the shelves 104*a*, 104*b*, 104*c* through a gravity fed configuration. The shelves 104*a*, 104*b*, 104*c* are defined by a wire mesh 106 arranged in a parallel, spaced-apart relationship. The wire mesh 106 of the shelves 104*a*, 104*b*, 104*c* are configured to enable carrying multiple cans in a load bearing manner.

The shelves 104*a*, 104*b*, 104*c* are further defined by a pair of side edges 108*a*, 108*b*, a rear edge 110, and a front edge 112 having a lip 114. The edges 108*a*, 108*b*, 110, 112 are disposed at opposing ends of the wire mesh 106. The edges 108*a*, 108*b*, 110, 112 form a perimeter for the wire mesh 106. Looking ahead to FIG. 14, the side edges 108*a*, 108*b* may include a plurality of hooks 138*a*, 138*b*, 138*c*, 138*d* that protrude to enable hinged attachment to the side panels 116*a*, 116*b*. A plastic cap 140 may cover the hooks 138*a*, 138*b*, 138*c*, 138*d* to prevent scratching on the surface of the side panels 116*a*, 116*b*.

Figure 12:
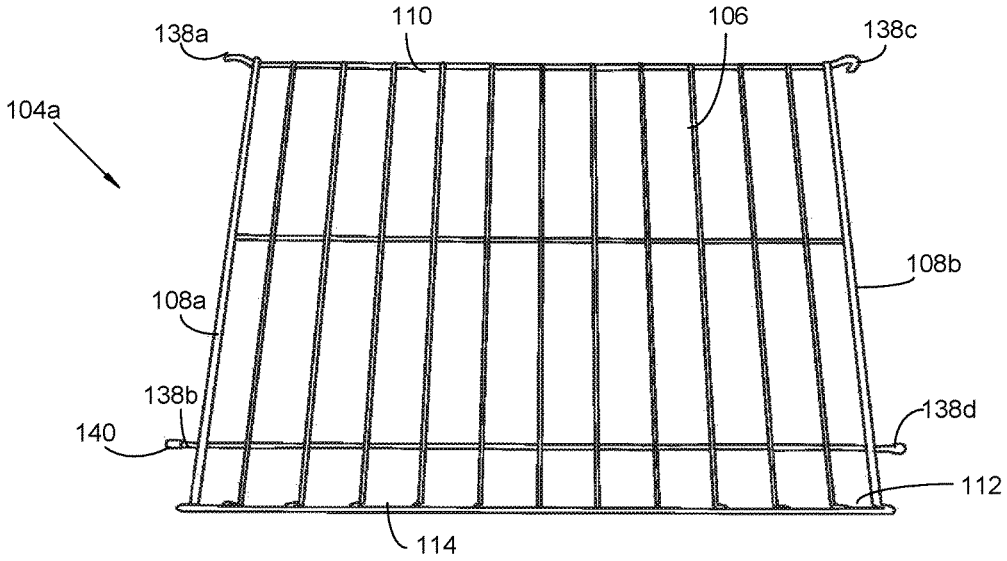
FIG. 12 illustrates a top view of a shelf, in accordance with an embodiment of the present invention.
Figure 13:
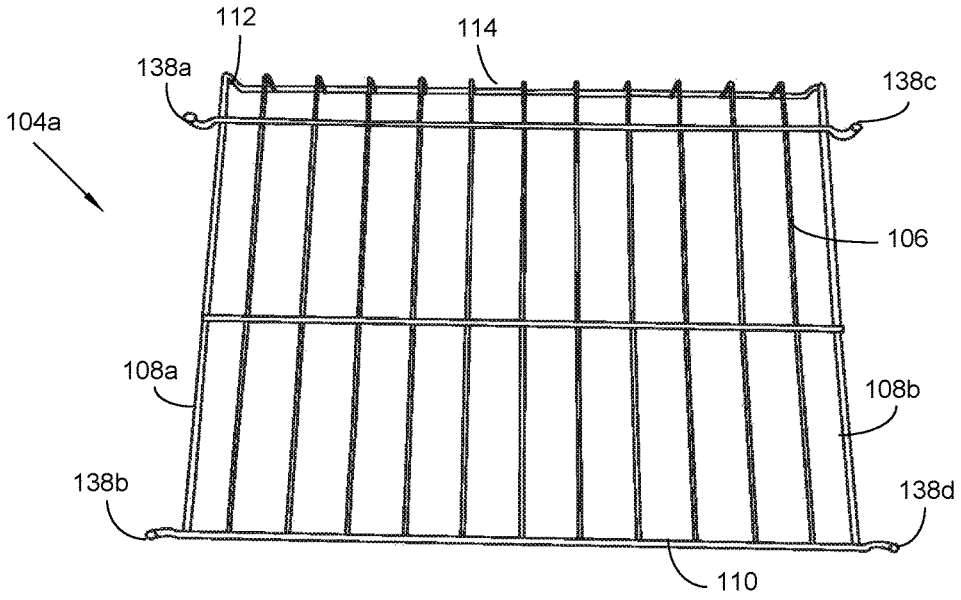
FIG. 13 illustrates a bottom view of the shelf shown in FIG. 12, in accordance with an embodiment of the present invention.
Figure 14:
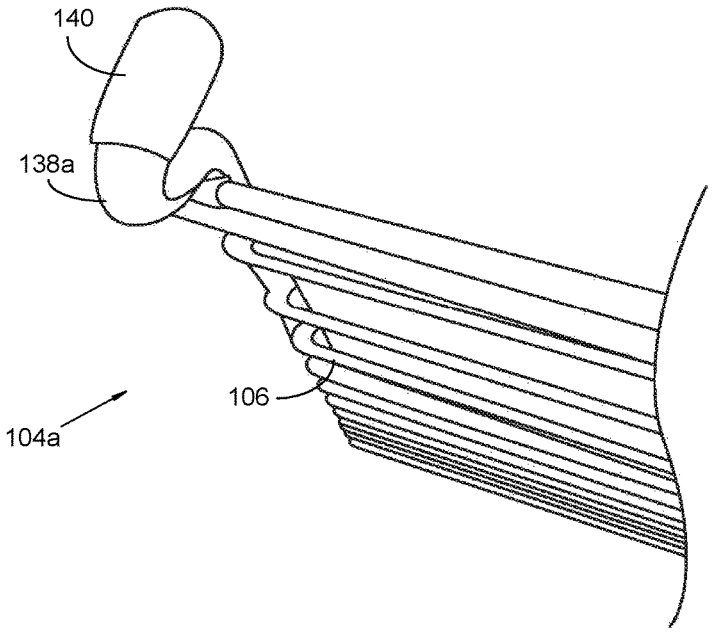
FIG. 14 illustrates a close up view of a hook and a cap on a side edge of a side panel, in accordance with an embodiment of the present invention.

Looking ahead to FIGS. 12 and 13, the shelves 104*a*, 104*b*, 104*c* provide sufficient surface area to support cans. In one embodiment, the supportive members of the shelves 104*a*, 104*b*, 104*c* may include wire mesh 106. In one embodiment, the wire mesh 106 has a minimum wire gauge of 0.105". In another embodiment, the plurality of shelves 104*a*, 104*b*, 104*c* have a generally rectangular, flat shape. Though other shapes and dimensions for the shelves 104*a*, 104*b*, 104*c* are possible.

The shelves 104*a*, 104*b*, 104*c* are disposed in a generally parallel, spaced-apart relationship, such that cans display vertically. Further, the shelves 104*a*, 104*b*, 104*c* are disposed at an angle, such that the rear edge 110 is elevated above the front edge 112. The angle may be sloped at about between 15° to 45°. The slope of the shelf allows the cans to roll form the rear edge 110 to the front edge 112 through a gravity fed configuration. The lip 114 on the front edge 112 restricts further rolling by the cans. The lip 114 may be oriented upwardly towards the rear edge 110.

Figure 4:
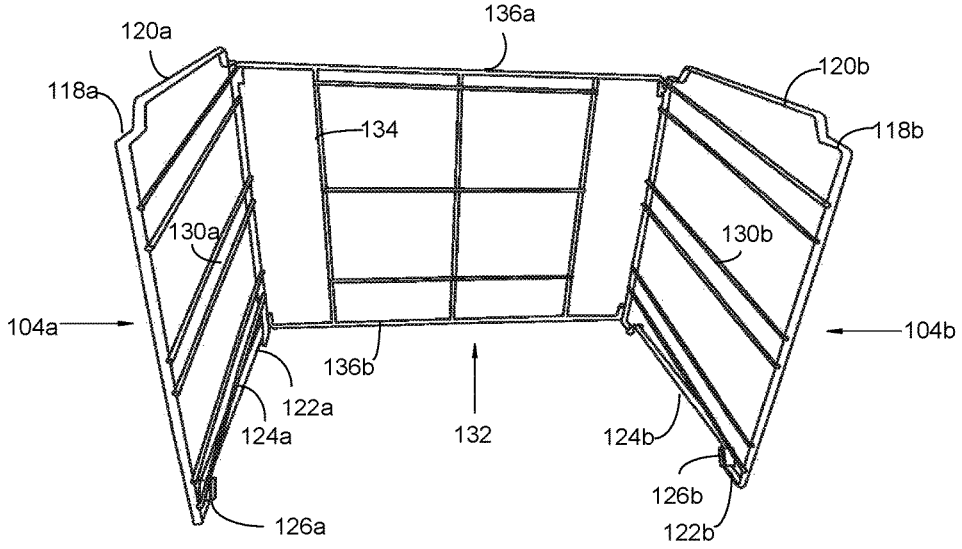
FIG. 4 illustrates a front perspective view of an exemplary back panel attached to a pair of side panels, in accordance with an embodiment of the present invention.
Figure 5:
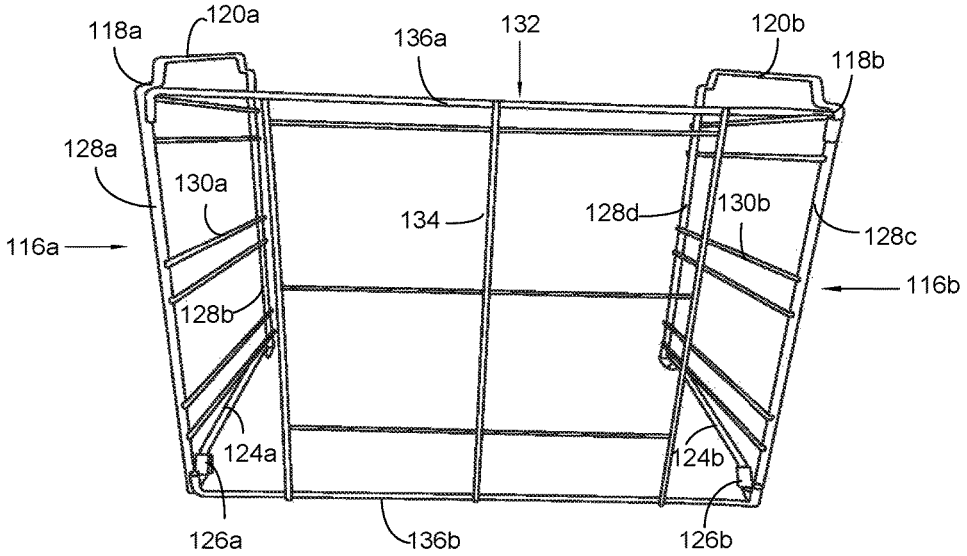
FIG. 5 illustrates a rear perspective view of an exemplary back panel attached to a pair of side panels, in accordance with an embodiment of the present invention.

Looking at FIGS. 4 and 5, the modular racks 102*a*, 102*b* further comprises a pair of side panels 116*a*, 116*b* configured to help support the plurality of shelves 104*a*, 104*b*, 104*c*. The side panels 116*a*, 116*b* detachably attach to the pair of side edges 108*a*, 108*b* of the shelves 104*a*, 104*b*, 104*c*. In some embodiments, the side panels 116*a*, 116*b* may be generally rectangular and flat in shape.

Figure 6:
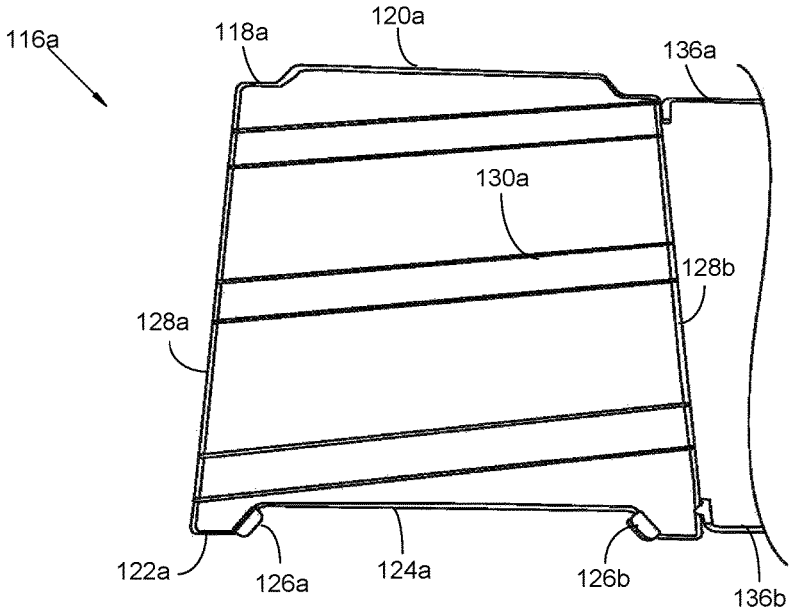
FIG. 6 illustrates a top view of a first shelf, in accordance with an embodiment of the present invention.

As referenced in FIG. 6, the side panels 116*a*, 116*b* also work to support subsequent modular racks 102*a*, 102*b* in the stacked configuration through use of a top flat bar 118*a*, 118*b* that extends across one end of the side panel, and a bottom flat bar 122*a*, 122*b* disposed opposite and parallel the top flat bar 118*a*, 118*b*.

Figure 7:
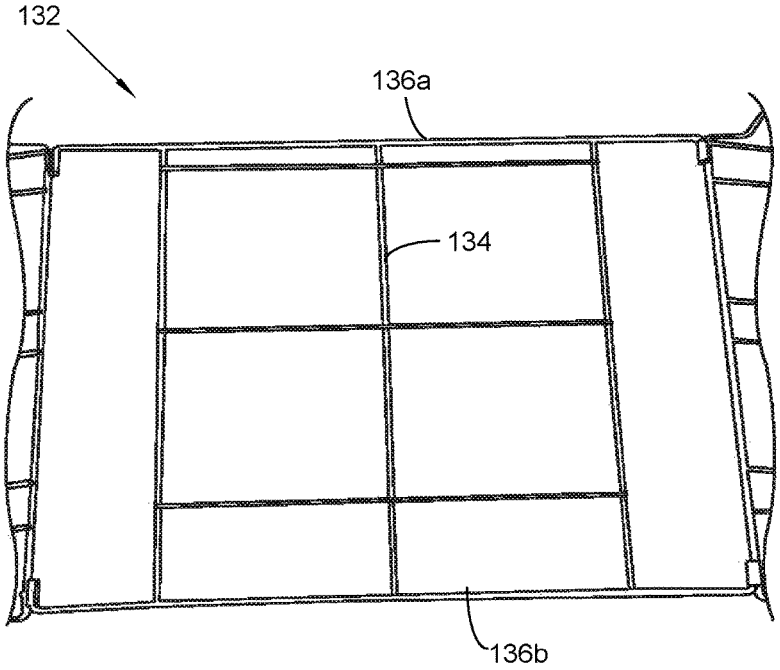
FIG. 7 illustrates a top view of a back panel, in accordance with an embodiment of the present invention.
Figure 8:
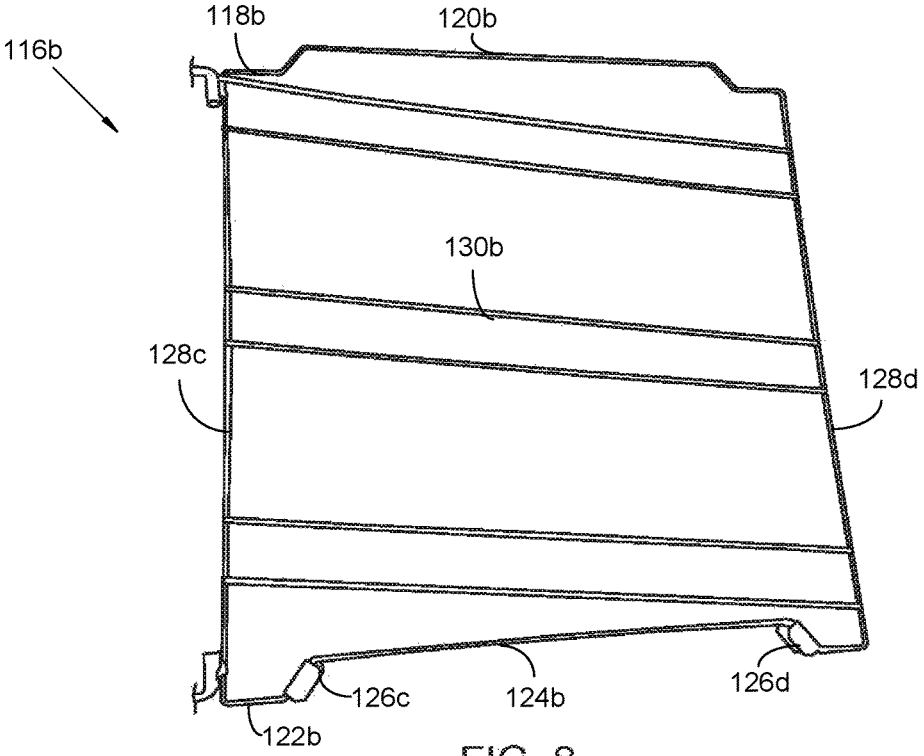
FIG. 8 illustrates a top view of a second shelf, in accordance with an embodiment of the present invention.

Looking at FIG. 7, the top flat bar 118*a*, 118*b* is defined by a convex hump 120*a*, 120*b* having a flat surface. The entire length of the top flat bar 118*a*, 118*b*, including the upper and lower surfaces of the convex hump 120*a*, 120*b* are substantially flat. The side panels 116*a*, 116*b* further comprise a bottom flat bar 122*a*, 122*b* defined by a concave hump 124*a*, 124*b* having a flat surface. Similar to the top flat bar 118*a*, 118*b*, the entire length of the bottom flat bar 122*a*, 122*b*, including the upper and lower surfaces of the concave hump 124*a*, 124*b* are substantially flat (FIG. 8).

Because of the flat surfaces, the convex hump 120*a*, 120*b* couples to the concave hump 124*a*, 124*b* to enable stacking of the plurality of modular racks 102*a*, 102*b*. Additionally, the coupling effect between the humps works to create structural integrity in the stacked configuration. In one embodiment shown in FIG. 9, the side panels 116*a*, 116*b* comprises side wire mesh 130*a*, 130*b* that cross the top flat bar 118*a*, 118*b* and bottom flat bar 122*a*, 122*b* to provide additional structural support. The side wire mesh 130*a*, 130*b* may cross longitudinally or transversely.

Figure 9:
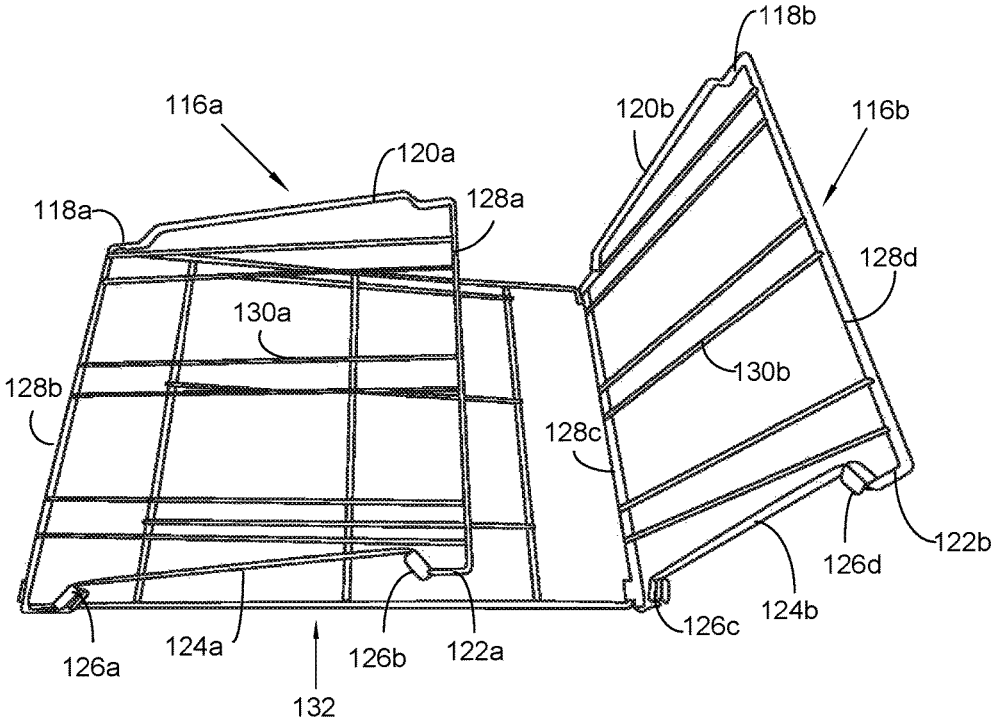
FIG. 9 illustrates a top view of a back panel attached to a pair of side panels moving to a collapsed position, in accordance with an embodiment of the present invention.
Figure 10:
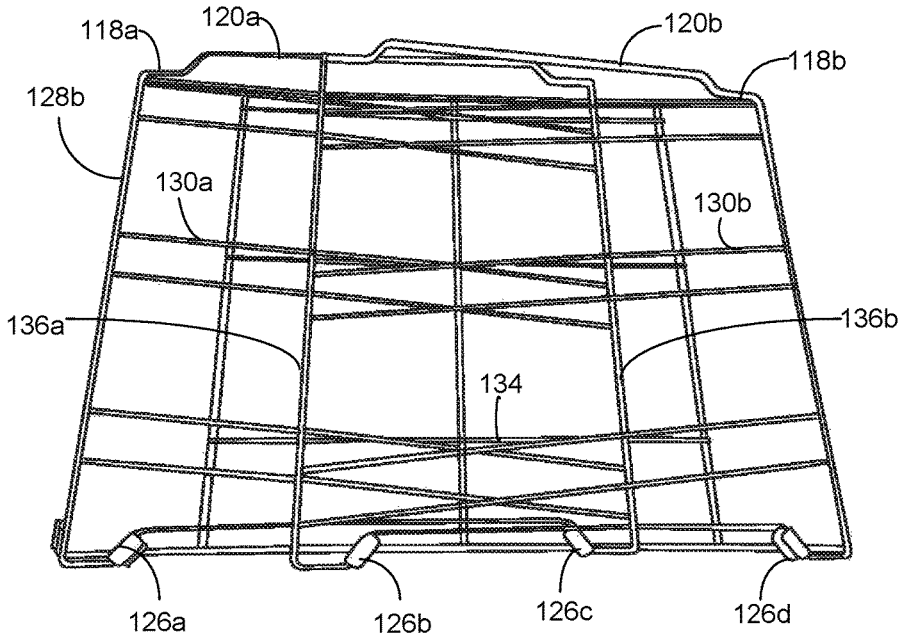
FIG. 10 illustrates a top view of a back panel attached to a pair of side panels in a fully collapsed position, in accordance with an embodiment of the present invention.

FIG. 9 illustrates a top view of the back panel 132 attached to a pair of side panels 116*a*, 116*b* that are moving to a collapsed position. FIG. 10 illustrates a top view of the back panel 132 attached to a pair of side panels 116*a*, 116*b* in a fully collapsed position. In this manner, the assembly 100 may be stowed and carried more easily. The generally flat shape of the fully collapsed position also enables multiple modular racks 102*a*, 102*b* to be packed and shipped.

Figure 11:
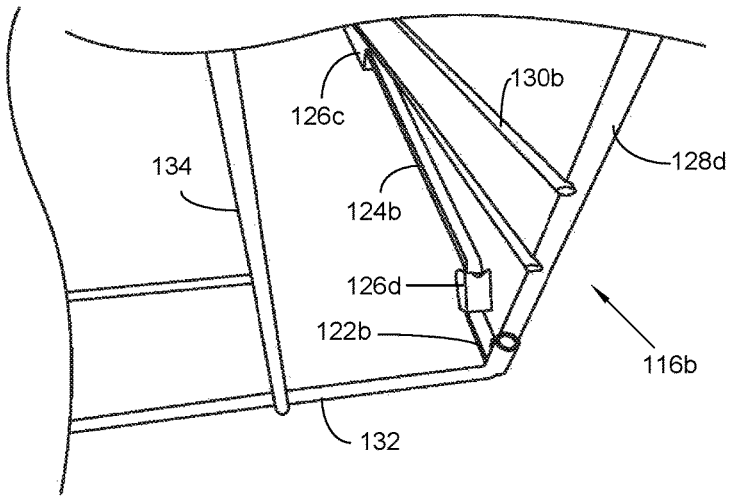
FIG. 11 illustrates a close up view of a side panel joined with a back panel, in accordance with an embodiment of the present invention.

As the close up view of FIG. 11 shows, at least one bracket 126*a*, 126*b*, 126*c*, 126*d* joins with the concave hump 124*a*, 124*b* of the bottom flat bar 122*a*, 122*b*. The bracket 126*a*, 126*b*, 126*c*, 126*d* may have a generally U-shape that overlaps a top surface area and sides of the bottom flat bar 122*a*, 122*b*. The bracket 126*a*, 126*b*, 126*c*, 126*d* is configured to help fasten the bottom flat bar 122*a*, 122*b* to the top flat bar 118*a*, 118*b*, such that stability is enhanced for stacking the modular racks 102*a*, 102*b*.

In one embodiment, the bracket 126*a*, 126*b*, 126*c*, 126*d* includes a generally U-shape that is sized and dimensioned to at least partially encapsulate the top flat bar 118*a*, 118*b* in the stacked arrangement, such that the bracket 126*a*, 126*b*, 126*c*, 126*d* snugly fits around the sides of the bottom and top flat bar 118*a*, 118*bs*.

Figure 15:
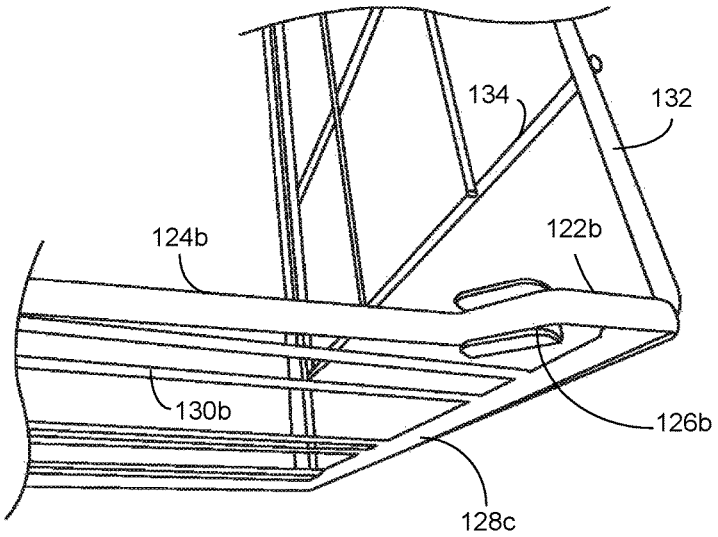
FIG. 15 illustrates a close up view of a bracket, in accordance with an embodiment of the present invention.

As FIG. 15 illustrates, each side panel 116*a*, 116*b* comprises a pair of side support bars 128*a*, 128*b*, 128*c*, 128*d* that are disposed in a parallel, spaced-apart relationship, extending between the top flat bar 118*a*, 118*b* and the bottom flat bar 122*a*, 122*b*. The side support bars 128*a*, 128*b*, 128*c*, 128*d* are disposed generally perpendicular to the flat bars. In one embodiment, the support bars 128*a*, 128*b* are vertical.

In some embodiments, the modular rack further comprises a back panel 132 disposed generally perpendicular to the pair of side panels 116*a*, 116*b*. The back panel 132 joins with the rear edge 110 of the plurality of shelves 104*a*, 104*b*, 104*c* to help support the plurality of shelves 104*a*, 104*b*, 104*c*. In some embodiments, the back panel 132 comprises a pair of back support bars 136*a*, 136*b* are disposed in a spaced-apart relationship.

In some embodiments, the back panel 132 may further include a back wire mesh 134 configured to enhance structural integrity of the back panel 132 by extending between the pair of back support bars 136*a*, 136*b*. The back wire mesh 134 may be arranged longitudinally or transversely across the pair of back support bars 136*a*, 136*b*.

The back panel 132, the pair of side panels 116*a*, 116*b*, and the plurality of shelves 104*a*, 104*b*, 104*c* are detachably attachable to enable compacting for stowage and easy assembly 100 for operation. Various fasteners, friction fit coupling arrangements, and the like may be used to join the panels and shelves 104*a*, 104*b*, 104*c*.

Figure 16:
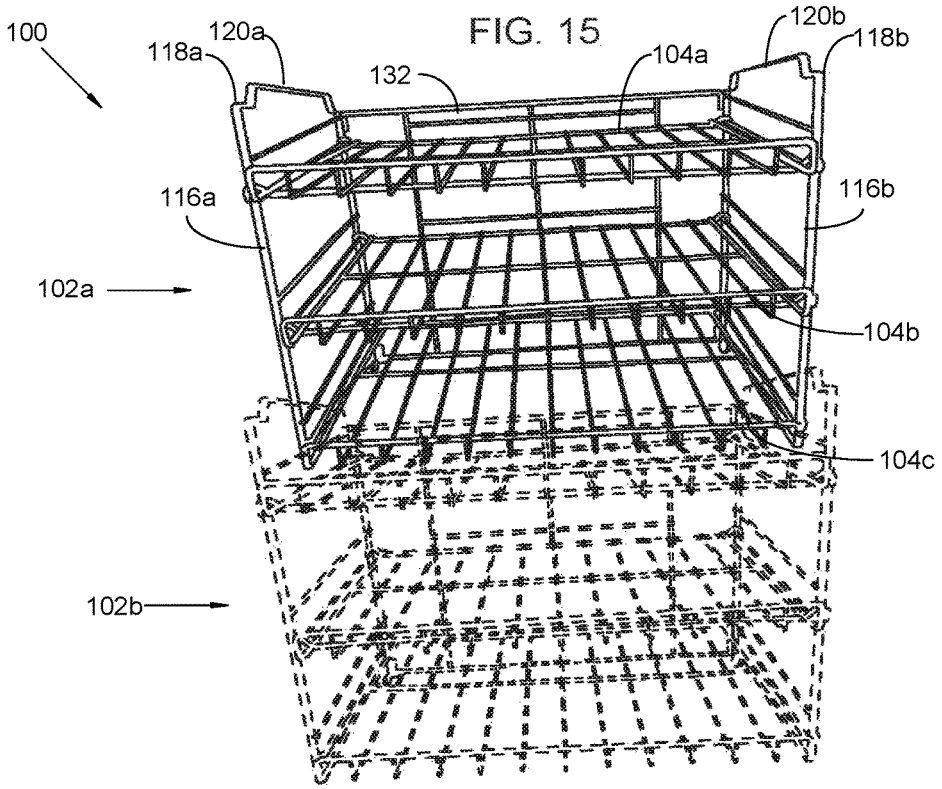
FIG. 16 illustrates a perspective view of a pair of modular racks in a stacked configuration, in accordance with an embodiment of the present invention.

As referenced in FIG. 16, in a stacked configuration of modular racks 102*a*, 102*b*, any combination of modular rack or racks may be added or removed to the stacked configuration as long as the flat surfaces and humps are aligned and coupled together. Generally, two modular racks 102*a*, 102*b* are stacked and multiple additional pairs of modular racks may position adjacent to each other to create a unique display and easy access to the cans. Each modular rack 102*a* may have any number of shelves 104*a*, 104*b*, 104*c*, depending on the display and accessibility requirements for the cans.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A stackable can rack assembly, the assembly comprising:

a plurality of modular racks having:

a plurality of shelves defined by wire mesh arranged in a spaced-apart relationship, the plurality of shelves further defined by a pair of side edges, a rear edge, and a front edge having a lip, the edges disposed at opposing ends of the wire mesh, the plurality of shelves disposed in a generally parallel, spaced-apart relationship, the plurality of shelves further disposed at an angle, whereby the rear edge is elevated above the front edge;

a pair of side panels configured to join with the pair of side edges of the plurality of shelves to help support the plurality of shelves, the pair of side panels including:

a top flat bar defined by a convex hump having a flat surface;

a bottom flat bar defined by a concave hump having a flat surface, whereby the concave hump couples to a convex hump of a subjacent modular rack to enable stacking of the plurality of modular racks;

at least one bracket configured to join with the concave hump of the bottom flat bar, the at least one bracket configured to at least partially fasten the bottom flat bar to a top flat bar of the subjacent modular rack;

a pair of support bars disposed in a parallel, spaced-apart relationship, the pair of support bars further disposed to extend between the top flat bar and the bottom flat bar, and a back panel disposed generally perpendicular to the pair of side panels, the back panel configured to join with the rear edge of the plurality of shelves to help support the plurality of shelves.

2. The assembly of claim 1, wherein the plurality of shelves is generally rectangular.

3. The assembly of claim 1, wherein the wire mesh of the plurality of shelves are disposed in a parallel, spaced-apart relationship.

4. The assembly of claim 1, wherein the lip extends upwardly in the direction of the rear edge of the plurality of shelves.

5. The assembly of claim 1, wherein the pair of side panels are generally rectangular and flat.

6. The assembly of claim 1, wherein the pair of side panels comprises side wire mesh configured to enhance structural integrity of the pair of side panels.

7. The assembly of claim 1, wherein the convex hump and the concave hump are configured to form a friction fit relationship.

8. The assembly of claim 1, wherein the at least one bracket comprises a generally U-shape that is sized and dimensioned to at least partially encapsulate the top flat bar when multiple modular racks are in a stacked arrangement.

9. The assembly of claim 1, wherein the pair of support bars are disposed generally perpendicular to the flat bars.

10. The assembly of claim 1, wherein the back panel is generally rectangular and flat.

11. The assembly of claim 1, wherein the back panel comprises a pair of back support bars disposed in a spaced-apart relationship.

12. The assembly of claim 11, wherein the back panel comprises back wire mesh configured to extend between the pair of back support bars for enhancing structural integrity of the back panel.

13. The assembly of claim 1, wherein the plurality of shelves comprises a plurality of hooks having a plastic cap.

* * * * *